United States Patent [19]

Joslyn et al.

[11] Patent Number: 5,050,737

[45] Date of Patent: Sep. 24, 1991

[54] SYSTEM FOR PACKAGING MOIST TOWELETTES

[75] Inventors: Daniel V. Joslyn; Randy L. Rudolph, both of Sheboygan, Wis.

[73] Assignee: Rockline, Inc., Sheboygan, Wis.

[21] Appl. No.: 530,016

[22] Filed: May 29, 1990

[51] Int. Cl.[5] ..... A47K 10/20

[52] U.S. Cl. ..... 206/494; 206/497; 206/524.8; 206/812; 221/46; 221/49

[58] Field of Search ..... 206/205, 494, 524.8, 206/812, 497, 484; 221/46, 48, 63, 49

[56] References Cited

U.S. PATENT DOCUMENTS

| | | | |
|---|---|---|---|
| 2,158,712 | 5/1939 | West | 221/49 |
| 3,358,415 | 12/1967 | Kurfirst | 206/497 X |
| 3,458,966 | 8/1969 | Dunbar et al. | 206/524.8 X |
| 3,499,575 | 3/1970 | Rockefeller | 206/812 X |
| 3,726,395 | 4/1973 | Duhy | 206/494 X |
| 3,784,055 | 1/1974 | Anderson | 221/46 |
| 3,795,355 | 3/1974 | Gerstein | 206/494 X |
| 3,836,044 | 9/1979 | Tilp et al. | 206/812 X |
| 3,836,045 | 9/1974 | Duhy et al. | 221/63 |
| 3,841,466 | 10/1974 | Hoffman et al. | 206/205 |
| 4,000,816 | 1/1977 | Spruyt | 206/812 X |
| 4,101,026 | 7/1978 | Bonk | 206/205 |
| 4,138,034 | 2/1979 | McCarthy | 221/48 |
| 4,411,374 | 10/1983 | Hotchkiss | 221/63 |
| 4,863,064 | 9/1989 | Dailey, III | 221/48 |

*Primary Examiner*—Bryon P. Gehman

*Attorney, Agent, or Firm*—Philip P. Mann; Michael D. Rechtin

[57] ABSTRACT

A system and method for packaging, containing and dispensing moist towelettes such as baby wipes. A main container for containing moist towelettes is provided. Moist towelettes in vertical stacked arrangement are enclosed within a disposable, moisture impermeable, flexible plastic envelope. The envelope can be opened and placed within the main container to load the main container with moist towelettes. Use of the envelope permits continued reuse of the main container to reduce costs and minimize waste.

4 Claims, 1 Drawing Sheet

SYSTEM FOR PACKAGING MOIST TOWELETTES

BACKGROUND OF THE INVENTION

This invention relates generally to packages and, more particularly, to packages and containers for moist towelettes such as baby wipes.

Premoistened, nonwoven towelettes designed for infant and baby care are well known and popular items. Such towelettes, commonly known as "baby wipes," greatly simplify infant and baby care and provide a real convenience to care givers.

For a number of reasons, baby wipes have unique packaging requirements. To prevent evaporation of the moisturizing fluids, baby wipe packages and containers must be provided with tight fitting lids, covers or other closure means. At the same time, such packages should be easy to open and should permit convenient one-handed removal of individual wipes with a minimum of effort and bother. In view of these requirements, a variety of sophisticated baby wipe packages and containers have been developed.

In raising a child through infancy and babyhood, hundreds if not thousands of baby wipes will typically be consumed. Many baby wipe packages will be purchased, used and disposed of during this time. Frequently, however, such packages are still usable when disposed of, as the primary reason for disposal is the depletion of the supply of wipes within the container. This runs to considerable waste and aggravates a number of environmental concerns such as waste disposal and depletion of resources.

In view of the foregoing, it is a general object of the present invention to provide a new and improved system and method for containing and dispensing baby wipes.

It is a further object of the present invention to provide a new and improved system and method for containing and dispensing baby wipes wherein existing packaging can be reused to minimize unnecessary waste.

It is a still further object of the present invention to provide a new and improved system and method for containing and dispensing baby wipes that minimizes waste yet is economical to manufacture and use and retains the handling convenience of existing packaging.

SUMMARY OF THE INVENTION

The invention provides a packaging system for moist towelettes including a main container having a hollow interior, a moisture impervious inner envelope, and a plurality of moist towelettes within the inner envelope. The inner envelope and the moist towelettes are shaped and dimensioned to be removably insertable within the interior volume of the main container.

The invention also provides a container system for moist towelettes including a generally rectangular main container formed of a relatively rigid plastic and having a hollow interior. The container system further includes a plurality of inserts removably insertable into the hollow interior of the main container. Each of the removable inserts includes a plurality of moist towelettes in stacked relation and further includes an outer envelope formed of a relatively flexible plastic enclosing the stacked plurality of moist towelettes.

The invention also provides a method of containing and dispensing moist towelettes, including the step of providing a main container having a hollow interior and an openable and closable cover providing controlled access to the hollow interior, and further including the step of providing a first insert removably insertable in the hollow interior. The first insert includes a plurality of moist towelettes in stacked arrangement and further includes an envelope surrounding and fully enclosing the plurality of moist towelettes. The method further includes the step of inserting the first insert into the hollow interior of the main container and removing at least a portion of the inner envelope so as to gain access to the moist towelettes therein contained.

BRIEF DESCRIPTION OF THE DRAWINGS

The features of the present invention which are believed to be novel are set forth with particularity in the appended claims. The invention, together with the further objects and advantages thereof, may best be understood by reference to the following description taken in conjunction with the accompanying drawings wherein like reference numerals identify like elements, and wherein:

DESCRIPTION OF THE PREFERRED EMBODIMENT

Figure 2:
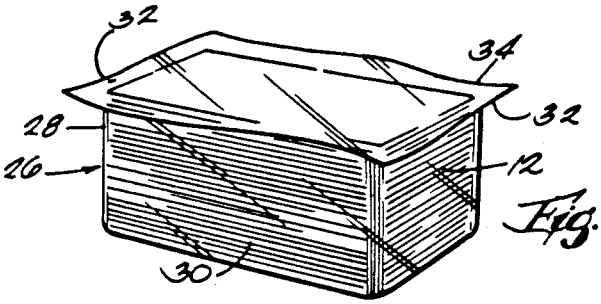
FIG. 2 is a perspective view of a moist towelette insert package embodying various features of the invention.
Figure 1:
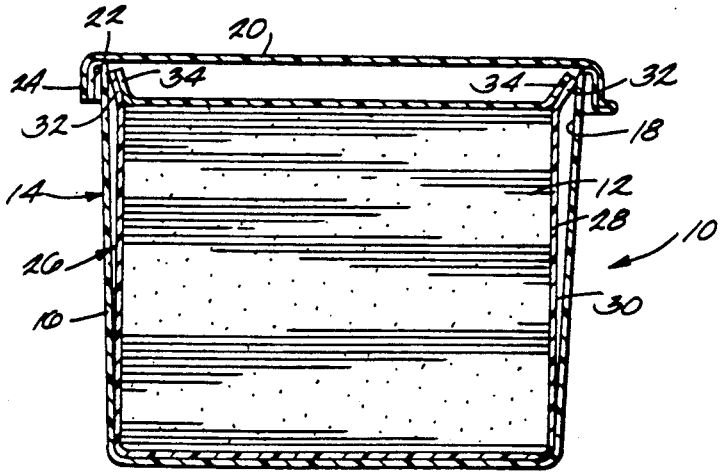
FIG. 1 is a cross-sectional view of a packaging system for moist towelettes embodying various features of the invention.

Referring to the drawings and, in particular, to FIGS. 1 and 2, a packaging system 10 for moist towelettes is illustrated. As shown, the moist towelettes preferably comprise a plurality of baby wipes 12 of known construction. In accordance with conventional practice, the baby wipes 12 comprise rectangular sheets of a suitable nonwoven material and are impregnated with a water based moisturizing agent. To prevent evaporation of the moisturizing agent and the concomitant drying of the baby wipes 12, it is important that the baby wipes 12 be kept in a closed or sealed container or package.

As further illustrated, the packaging system 10 includes an outer or main container 14 including a tub portion 16 having a hollow interior 18 dimensioned to receive therein the moist towelettes 12 when the towelettes 12 are arranged in vertically stacked arrangement. As shown, the main container 14 is of generally rectangular form conforming to the rectangular shape of the stacked baby wipes 12. The main container 14 includes a hinged cover 20 that can be opened and closed over the hollow interior 18 of the tub portion 16. A peripheral flange 22 around the upper edge of the tub portion 16 cooperates with a similar flange 24 around the hinged cover 20 to form a seal for minimizing evaporation of the moisturizing agent of the moist towelettes contained within the main container 14. Preferably, the main container 14 is formed of an injection molded, moisture impervious, relatively rigid, thermoplastic material.

In practice, the plastic main container 14 frequently has a useful life that greatly exceeds that of the supply of moist towelettes 12 therein contained. Accordingly, it can be wasteful to dispose of the main container 14 merely because the towelette supply has been depleted. To avoid such wastage, the packaging system 10, in accordance with one aspect of the invention, includes a moist towelette insert package 26 having an inner envelope 28 for containing the vertically stacked moist towelettes 12. The inner envelope 28 is formed of a relatively flexible, moisture impervious plastic. Preferably, the inner envelope 28 includes a lower or bottom portion 30 that closely surrounds five sides of the stacked towelettes 12 and further includes a top flap or cover portion 32 that covers the remaining side of the stack. Both portions 30, 32 include, around their peripheries, sealing flaps or flanges 32, 34 that are welded or otherwise joined to each other to form a sealed enclosure around the stacked moist towelettes 12. The inner envelope 28 and the towelettes 12 therein contained are shaped and dimensioned to be removably insertable within the hollow interior 18 of the main container 14.

Figure 3:
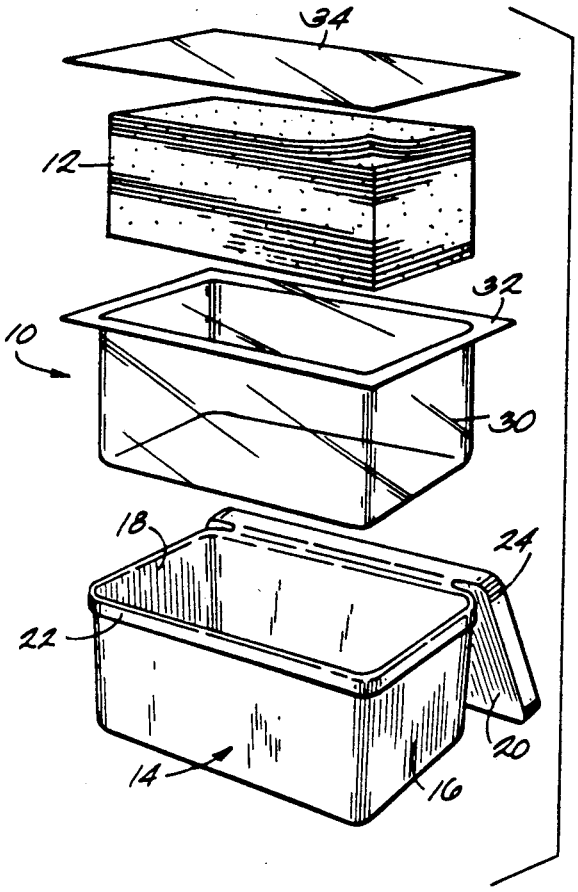
FIG. 3 is an exploded perspective view of a packaging system for moist towelettes embodying various features of the invention, useful in understanding one method of utilizing the packaging system.
Figure 4:
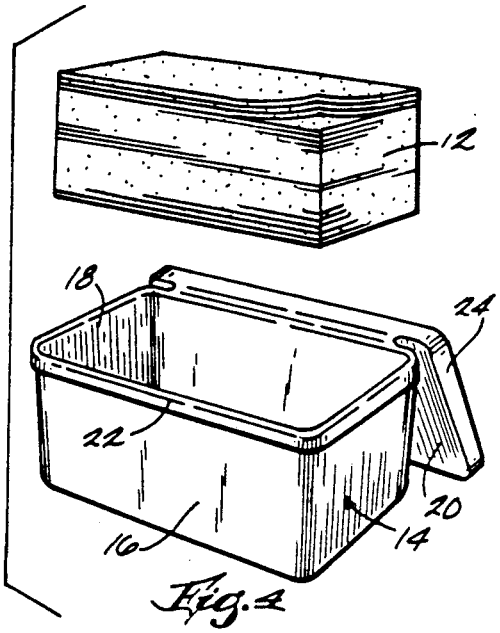
FIG. 4 is an exploded perspective view of a packaging system for moist towelettes useful in understanding another method of utilizing the system.

To gain access to the moist towelettes 12 within the inner envelope 28, the top flap 32 is separated from the remainder of the envelope 28 by peeling the peripheral flanges 32, 34 away from each other. Once the inner envelope 28 is thus opened, the stacked towelettes 12, along with the remaining or bottom portion 30 of the inner envelope 28, can be inserted into the hollow interior 18 of the main container 14 as illustrated in FIG. 3. Alternatively, the entire inner envelope 28 can be removed from the stacked moist towelettes 12 and the towelettes inserted in the hollow interior 18 of the main container 14 as shown in FIG. 4.

Use of a moist towelette insert package 26 including a moisture impervious, relatively flexible inner envelope 28 fully surrounding a stack of moist towelettes, allows the main container 14 to be periodically recharged with fresh towelettes. This, in turn, permits reuse of the main container 14 long after the initial supply of moist towelettes 12 is depleted. Initially, a consumer can purchase a main container 14 having therein contained a supply of moist towelettes 12. Following depletion of the initial supply, the consumer need only purchase additional ones of the moist towelette insert packages 26 as shown in FIG. 2 to replenish the supply of towelettes 12 within the main container 14 as needed. This avoids the need to purchase a new main container with each purchase of towelettes. This, in turn, results in less waste, improved economy, and best use of available resources.

It will be appreciated that modifications can be made to the packaging system 10 and method as herein described. For example, the precise number or shape of the towelettes 12 contained in the package are not critical. Nor are the precise plastics used in the manufacture of the main container 14 and inner envelope 28.

While a particular embodiment of the invention has been shown and described, it will be obvious of those skilled in the art that changes and modifications may be made without departing from the invention in its broader aspects, and, therefore, the aim in the appended claims is to cover all such changes and modifications as fall within the true spirit and scope of the invention.

We claim:

1. A disposable baby wipe insert package for use in conjunction with a durable main container formed of a moisture impervious self-sustaining plastic, said insert package comprising;

a plurality of premoistened disposable baby wipes arranged in vertically stacked relation so as to form a solid generally rectangular stack having six sides;

a first membrane formed of a flexible moisture impervious non-self-sustaining plastic, said first membrane defining an open ended five-sided generally rectangular interior cavity having substantially the size and shape of said stack of said baby wipes and containing therein said stack of said baby wipes, said first membrane further including an outwardly extending peripheral flange around the periphery of the open end of said interior cavity, said peripheral flange being substantially coplanar with the adjacent surface of said stack of said baby wipes when said stack is within said interior cavity;

a generally rectangular second membrane formed of a flexible moisture impervious non-self-sustaining plastic disposed over said open end of said interior cavity, said second membrane including an outer peripheral portion overlying said peripheral flange of said first membrane; and sealing means for sealing said outer peripheral portion of said second membrane to said peripheral flange of said first membrane to thereby seal said stack of said baby wipes within said interior cavity, said sealing means being releasable to permit said second membrane to be peeled away from said first membrane to thereby expose said stack of said baby wipes within said interior cavity of said first membrane;

said first and second membranes being shaped and dimensioned so that substantially the entire outer surface of said stack of said baby wipes is in contact with substantially the entire inner periphery of the interior volume defined by said first and second membranes when said stack of said baby wipes is contained by said first and second membranes.

2. A disposable baby wipes insert package as defined in claim 1 wherein said stack of said baby wipes is packaged within said first and second membranes under partial vacuum so that said first and second membranes are pressed firmly into engagement with the sides of said stack under the influence of atmospheric pressure.

3. A partially reusable container system for packaging, shipping, storing and using premoistened disposable baby wipes in an economical and environmentally responsible manner, said container system comprising:

a relatively durable main container formed of a moisture impervious, self-sustaining plastic, said main container having a hollow interior accessible through an opening substantially as large as the plan view dimension of said hollow interior to permit unencumbered access to said hollow interior, said main container further including a closeable lid for selectively sealing said opening;

a substantially rectangular six-sided stack of premoistened disposable baby wipes, each of said baby wipes being of substantially rectangular configuration; and a relatively disposable inner envelope formed of a pair of flexible, non-self-sustaining moisture impervious plastic membranes engaging and completely surrounding said stack of premoistened disposable baby wipes in close proximity thereto, the first of said membranes covering five sides of said stack of said baby wipes and the second of said membranes comprising a substantially planar sheet defining a removable cover covering the remaining side of said stack, said inner envelope contacting substantially the entire outer surface of said stack, said inner envelope comprising substantially less plastic than said main container;

said hollow interior of said main container being shaped and dimensioned to receive therein said inner envelope and said stack of baby wipes therein disposed so that individual ones of said baby wipes can be easily removed from said hollow interior through said opening following removal of said second membrane and so that a fresh stack of said baby wipes can be replaced into said hollow interior of said main container from a fresh one of said inner envelopes following depletion of the initial stack of said baby wipes.

4. A container system as defined in claim 3 wherein said stack of said baby wipes is packaged within said first and second membranes under partial vacuum so that said first and second membranes are pressed firmly into engagement with the sides of said stack under the influence of atmosphere pressure.

* * * * *